US007975511B2

(12) United States Patent
Flad et al.

(10) Patent No.: US 7,975,511 B2
(45) Date of Patent: Jul. 12, 2011

(54) KNITTING MACHINE FOR PRODUCING A KNITTED PRODUCT FROM UNTWISTED FIBRE MATERIAL

(75) Inventors: Axel Flad, Burladingen (DE); Wolfgang Bauer, Kornwestheim (DE)

(73) Assignee: SIPRA Patententwicklungs- und Beteiligungsgesellschaft mbH, Albstadt (DE)

( * ) Notice: Subject to any disclaimer, the term of this patent is extended or adjusted under 35 U.S.C. 154(b) by 58 days.

(21) Appl. No.: 12/524,457

(22) PCT Filed: Jan. 22, 2008

(86) PCT No.: PCT/DE2008/000131

§ 371 (c)(1),
(2), (4) Date: Jul. 24, 2009

(87) PCT Pub. No.: WO2008/089744

PCT Pub. Date: Jul. 31, 2008

(65) Prior Publication Data

US 2010/0095710 A1 Apr. 22, 2010

(30) Foreign Application Priority Data

Jan. 25, 2007 (DE) ..... 10 2007 004 441

(51) Int. Cl.
*D04B 9/14* (2006.01)

(52) U.S. Cl. ..... 66/9 B

(58) Field of Classification Search ..... 66/9 B, 66/168, 191, 198, 196, 8
See application file for complete search history.

(56) References Cited

U.S. PATENT DOCUMENTS

| | | | | |
|---|---|---|---|---|
| 1,578,710 | A * | 3/1926 | Byrd | 66/141 |
| 2,796,752 | A * | 6/1957 | Hauberg | 66/136 |
| 2,993,229 | A * | 7/1961 | Laws et al. | 226/168 |
| 5,160,097 | A * | 11/1992 | Josefsson et al. | 242/365.3 |
| 5,809,804 | A * | 9/1998 | Kuhrau et al. | 66/9 B |
| 6,151,920 | A * | 11/2000 | Schindler et al. | 66/9 R |
| 6,182,475 | B1 * | 2/2001 | Lee | 66/136 |
| 7,634,920 | B2 * | 12/2009 | Koenig | 66/9 B |
| 2006/0272357 | A1 * | 12/2006 | Koenig | 66/9 B |
| 2009/0064719 | A1 | 3/2009 | Koenig et al. | |

FOREIGN PATENT DOCUMENTS

| | | |
|---|---|---|
| DE | 10 2006 006 502 | 8/2007 |
| DE | 10 2006 011 212 | 9/2007 |

(Continued)

*Primary Examiner* — Danny Worrell
(74) *Attorney, Agent, or Firm* — Michael J. Striker

(57) ABSTRACT

A machine for producing a knitted product by at least partly using untwisted fiber material (4) includes at least one stitch forming system, on which stitch-forming elements (3) can be brought into a fibre pick-up position. A thread guide (27) is associated with the stitch-forming system and has a passage (30) for the fibre material (4). A drafting assembly (9) is associated with the stitch-forming system for attenuation of the fibre material and a spinning device (15), which is arranged between the drafting assembly (9) and the thread guide (27) and contains at least one spinning element (16) working with a blast air flow and a transport tube (17) connected thereto. The transport tube (17) contains an outlet end (17*d*) for the fibre material opening into the thread guide (27). The outlet end (17*d*) has an inner cross-section (D2), which is exactly the same size as or smaller than an inner cross-section (D1) at an outlet end of the passage (30). The intensity of the blast air flow is selected such that this is sufficient at least to securely transport the fibre material (4) as far as the stitch forming elements (3) without further auxiliary means.

12 Claims, 6 Drawing Sheets

FOREIGN PATENT DOCUMENTS

| | | |
|---|---|---|
| DE | 10 2006 037 714 | 2/2008 |
| EP | 1 518 949 | 3/2005 |
| EP | 1 826 299 | 8/2007 |
| WO | 2004/079068 | 9/2004 |

* cited by examiner

KNITTING MACHINE FOR PRODUCING A KNITTED PRODUCT FROM UNTWISTED FIBRE MATERIAL

BACKGROUND OF THE INVENTION

The invention relates generally to a knitting machine for producing a knitted product.

A known machine of this type configured as a circular knitting machine (PCT WO 2004/079 068 A2) is distinguished in that directly after its exit from a drafting assembly the fibre material used for knitting is transformed into a yarn by means of a spinning device. It is particularly advantageous that it is transformed into a temporary yarn with genuine twists and the temporary twists of the fibre material are retained during the entire transport process. As a result, it is possible, on the one hand, to transport the fibre material over longer distances from the drafting assembly to an associated knitting system in spite of its low strength compared to usual yarns, since as a result of this artificial handle the fibre material formed into a temporary yarn meets all the strength requirements on the transport path from the drafting assembly to the knitting system. Therefore, the fibre material can be transported over long distances without there being any risk of it unraveling or tearing. On the other hand, on the short distance from the outlet end of the spinning device to the knitting system, i.e. until the fibre material runs into the knitting needles, the twists in the temporary yarn are reduced to zero (false twist principle), so that the fibre material actually processed in the knitted product does not consist of a twisted yarn, but of substantially untwisted staple fibres arranged parallel to one another. Consequently, a knitted product of extreme softness is obtained as end product.

Alternatively, the spinning device can be configured to form a permanently bonded, in particular a so-called unconventional yarn and can be configured e.g. as an air spinning device (cf. e.g. EP 1 518 949 A2 and EP 1 826 299 A2). Such a yarn also has some twists or windings, but is not a yarn in the classic sense such as e.g. a bundle or covering yarn. The spinning process is preferably adjusted so that, as in the case of the temporary yarn described above, a sufficiently firm sliver is formed that is sufficient for the desired transport purposes, but a sufficiently soft knitting product is still obtained.

A perceived disadvantage is that the known machine is provided with a suction element on the side of the thread guide remote from the spinning device and on the rear side of the needles. The purpose of this suction element should be to tension the fibre material coming from the thread guide radially to the needle cylinder axis and keep it tensioned, so that it is taken up by the knitting needles raised into a fibre pick-up position and processed into stitches. Moreover, the suction element has been considered necessary hitherto to facilitate start-up of the circular knitting machine, in particular after a short machine stop or a break in the fibre material.

Besides the additional costs, such a suction element above all involves a high energy consumption, since such a suction element must be provided at each of the 48 or more knitting systems, for example, of the circular knitting machine. In addition, there is the risk of the suction element not taking up all the entrained fibres in the extracted fibre material and therefore of undesirable accumulations of fibres (so-called lumps) forming that drop into the tubular knit and foul it.

Working from this, the technical problem forming the basis of the invention is to configure the machine of the above-indicated type without increasing the structural expenditure so that the suction element can be omitted altogether.

The invention is based on the concept of using blast air used for the temporary yarn in the transport tube at the same time to insert the fibre material into the knitting needles and/or to transport the fibre material to behind the needle line formed by the knitting needles. This is achieved with the features of the invention without the blast pressure in the transport tube having to assume undesirably high values and without the risk of the fibre material and detached fibres accumulating in an interstice between the transport tube and the thread guide or in the passage of the thread guide, of undesirable turbulences occurring and/or other faults occurring that prevent the insertion of the fibre material into the knitting needles or impair the finished knitted product. Apart from this, there result the additional advantages that the blast air flow discharging from the passage of the thread guide causes a constant self-cleaning of the knitting needles and can also be used advantageously during the start-up of the circular knitting machine.

BRIEF DESCRIPTION OF THE DRAWINGS

The invention shall be explained in more detail below by way of exemplary embodiments in association with the attached drawings.

DETAILED DESCRIPTION OF THE PREFERRED EMBODIMENTS

Figure 1:
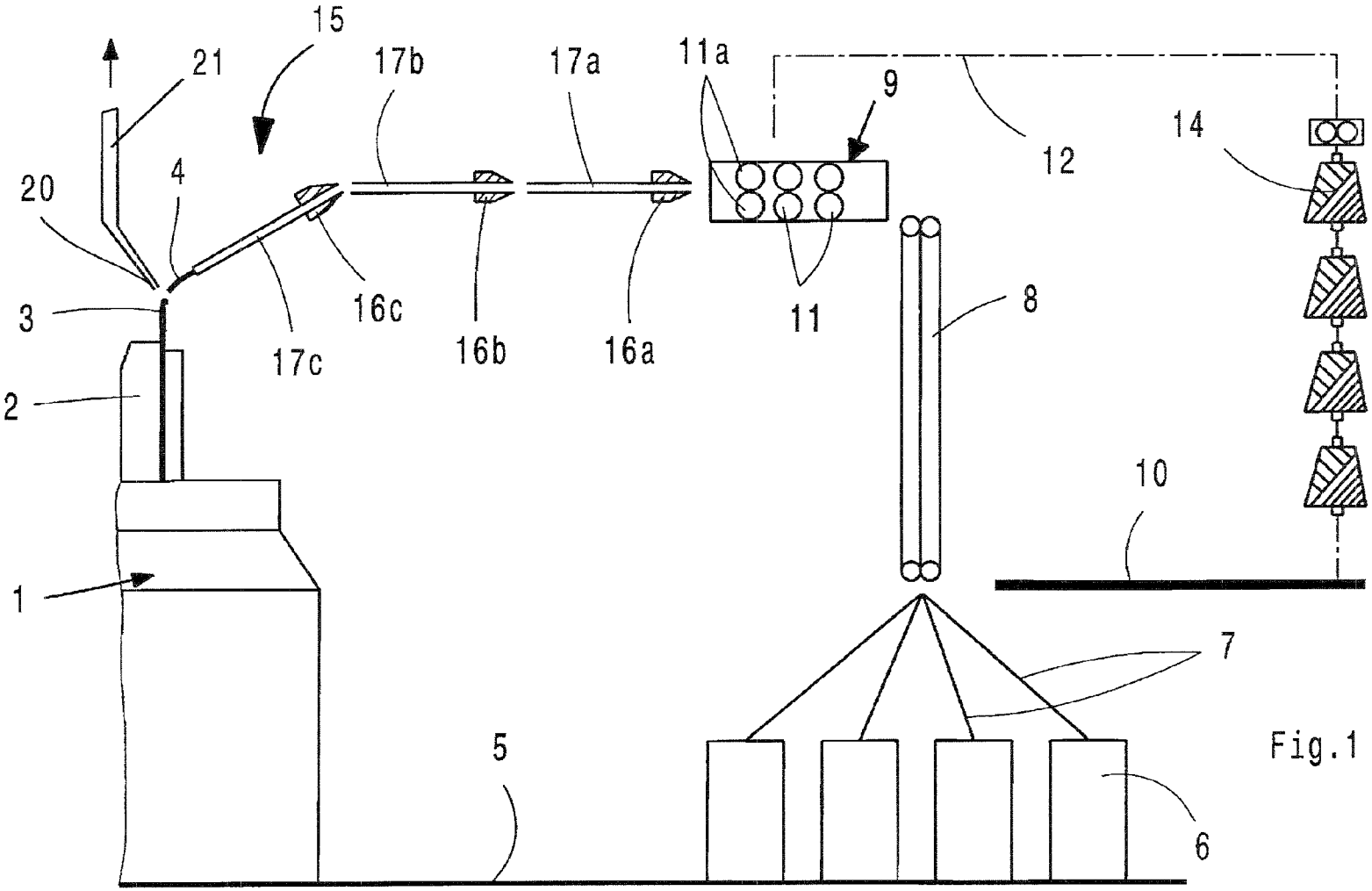
FIG. 1 schematically shows a circular knitting machine suitable for the purposes of the invention for producing a knitted product from fibre materials substantially consisting of untwisted staple fibres.

FIG. 1 is a roughly schematic view in a vertical part-section of a circular knitting machine 1 with a needle cylinder 2, in which standard knitting needles 3 forming a needle line are displaceably disposed, which can be moved at a knitting location, referred to hereafter as knitting system, by means of cam parts (not shown) into a pick-up position suitable for picking up fibre material 4. The circular knitting machine 1, which can be configured, for example, as a right/left circular knitting machine, stands on a floor, indicated by reference numeral 5, of a factory building or knitting room. An operator can operate the knitting machine 1 from the factory floor 5. In addition, a plurality of cans 6 are placed on the factory floor 5, in which slivers 7 consisting of fibres are deposited. Supply coils for flyer frame slivers could also be provided instead of the cans 6.

The slivers 7 are fed via transport means 8 configured as transport belts, for example, to a drafting assembly 9, which is accessible to the operator from a working platform 10 arranged above the factory floor 5. Each of a plurality of knitting systems, of which only one is shown in FIG. 1, is provided with such a drafting assembly, which has three pairs of drafting rollers 11 in a manner known per se, for example. Moreover, an auxiliary thread 12 unwound from a supply coil 14 can be fed to each knitting system, when required. The auxiliary thread 12 can be fed selectively to the knitting system either by means of a thread guide directly or, as FIG. 1 shows, by means of a front roller pair 11*a* of the drafting assembly 9.

Figure 2:
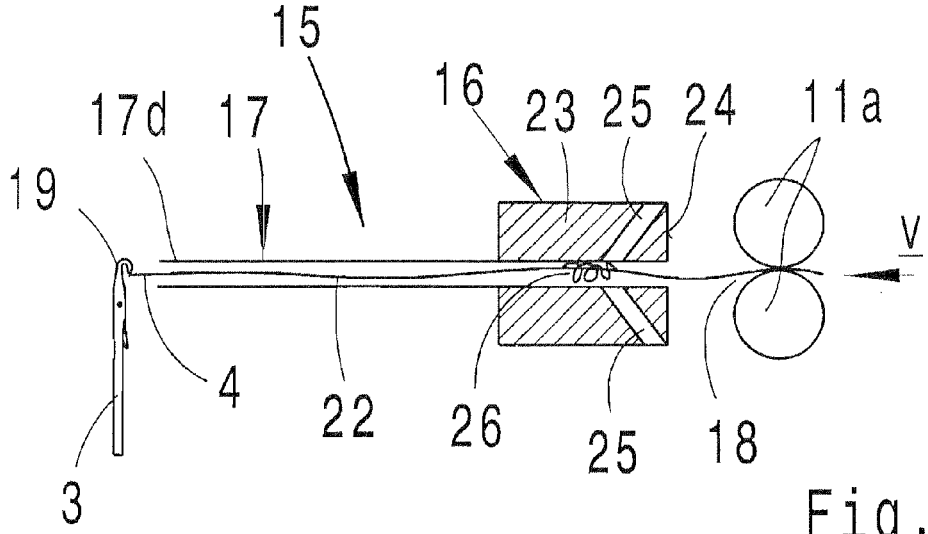
FIG. 2 is a schematic view in longitudinal section through a spinning device of the circular knitting machine according to FIG. 1.

A sliver coming from the drafting assembly 9 consisting of substantially untwisted staple fibres arranged parallel to one another is fed to an associated knitting system by means of a spinning device given the general reference 15, as may be seen more precisely in FIG. 2. According to an exemplary embodiment currently considered the best, the spinning device 15 contains at least one twist element 16 and a spinning or transport tube 17 connected thereto, wherein in the exemplary embodiment according to FIG. 1 three twist elements 16*a*, 16*b*, 16*c* and transport tubes 17*a*, 17*b*, 17*c* are connected one behind the other because of the comparatively large distance of the circular knitting machine 1 from the drafting assembly 9. The first twist element 16*a* in the transport direction of the fibre material 4 is arranged directly behind the front roller pair 11*a* of the drafting assembly 9, i.e. in its outlet gusset 18, whereas the last transport tube 17*c* in the transport direction terminates in close proximity to hooks 19 of the knitting needles 3 raised into the fibre pick-up position on the respective knitting system. Finally, a suction element 20 connected to a central extraction means 21, for example, is arranged behind the knitting needles 3.

As shown in FIG. 2, the spinning device 15 or each unit consisting of a twist element 16 and a transport tube 17 serves to transform the sliver discharged from the drafting assembly 9 firstly into a temporary yarn 22 (FIG. 2) with genuine twists. For this purpose, the twist element 16 is formed from a substantially hollow-cylindrical body 23, for example, the inner cavity of which receives the leading section of the transport tube 17 and with this closes flush on a front face 24. At least one air duct 25, preferably a multiplicity of air ducts 25, extends from the face 24, these ducts all being arranged on an angle to the centre axis of the transport tube 17. The air ducts 25 pass through the wall of the body 23 and the transport tube 17 and terminate at an inside wall of the transport tube 17. The radial spacing of the air ducts 25 gradually decreases from the face 23 in transport direction (arrow v), so that the preferably straight air ducts 25 respectively form an angle of approximately 45° with the centre axis of the transport tube 17. During operation, compressed or blast air is fed by means (not shown) to the ends of the air ducts 25 adjoining the outer side of the body 23, so that the twist element 16 draws the fibre material appearing in the outlet gusset 18 of the front roller pair 11*a* into the transport tube 17 and at the same time also passes it on through the transport tube 17 towards the respective knitting system. Moreover, because of the sloping arrangement of the air ducts 25 eddies 26 are generated in the transport tube 17 in such a manner that the fibre material coming from the front rollers 11*a* is not only sucked in, but is also spun into the temporary yarn 22 by subjecting it to a plurality of rotations that simultaneously compact the fibre material. The temporary yarn 22 retains the twists essentially until the end of the transport tube 17, whereupon these twists then unravel again as the last received fibre material 4 enters the knitting needles 3, i.e. are reduced to zero (false twist principle). Thus, a compacted, but virtually untwisted fibre material 4 enters the knitting needles 3. The same effect is obtained if three units consisting of twist elements and transport tubes 16*a*/17*a* to 16*c*/17*c* are connected one behind the other, as shown in FIG. 1. These units can also be arranged at preselected angles in relation to one another, as shown in FIG. 1, as a result of which it is possible to transport the attenuated fibre material coming out of the drafting assembly 9 over comparatively long distances without it being damaged.

Corresponding arrangements result when other spinning devices are used, as was mentioned briefly above.

Circular knitting machines of the described type are known from patent document PCT WO 2004/079 068 A2, for example, which is herewith incorporated by reference into the present disclosure to avoid repetition.

Figure 3:
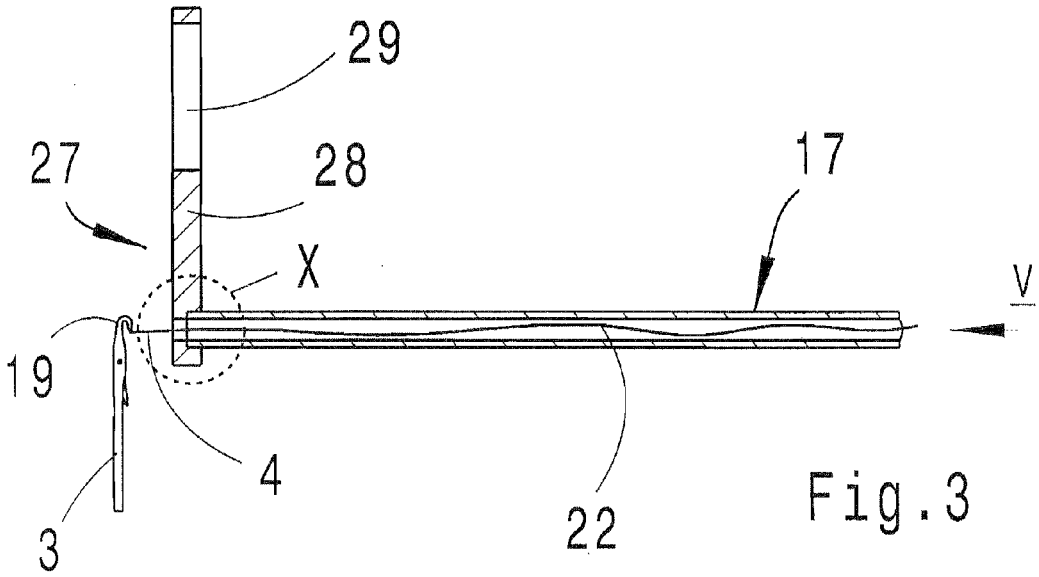
FIG. 3 shows a longitudinal section through a transport tube and a thread guide for the circular knitting machine of FIG. 1 according to a preferred exemplary embodiment of the invention.

FIG. 3 schematically shows a configuration according to the invention of one of the spinning or transport tubes 17 described on the basis of FIGS. 1 and 2 in combination with an associated thread guide 27 and a knitting needle 3 located in the pick-up position. The thread guide 27 preferably comprises a substantially plan-parallel plate 28. This is expediently configured such that, as in circular knitting machines that process conventional yarns, the thread guide 27 at the same time also performs other functions and, for example, can cause the hooks 19 of the knitting needles 3 to be opened or held open if these are configured as latch needles. Moreover, the plate 28 is expediently provided with an elongated hole 29, which serves to vertically adjust the thread guide 27 relative to the knitting needles 3.

Figure 4:
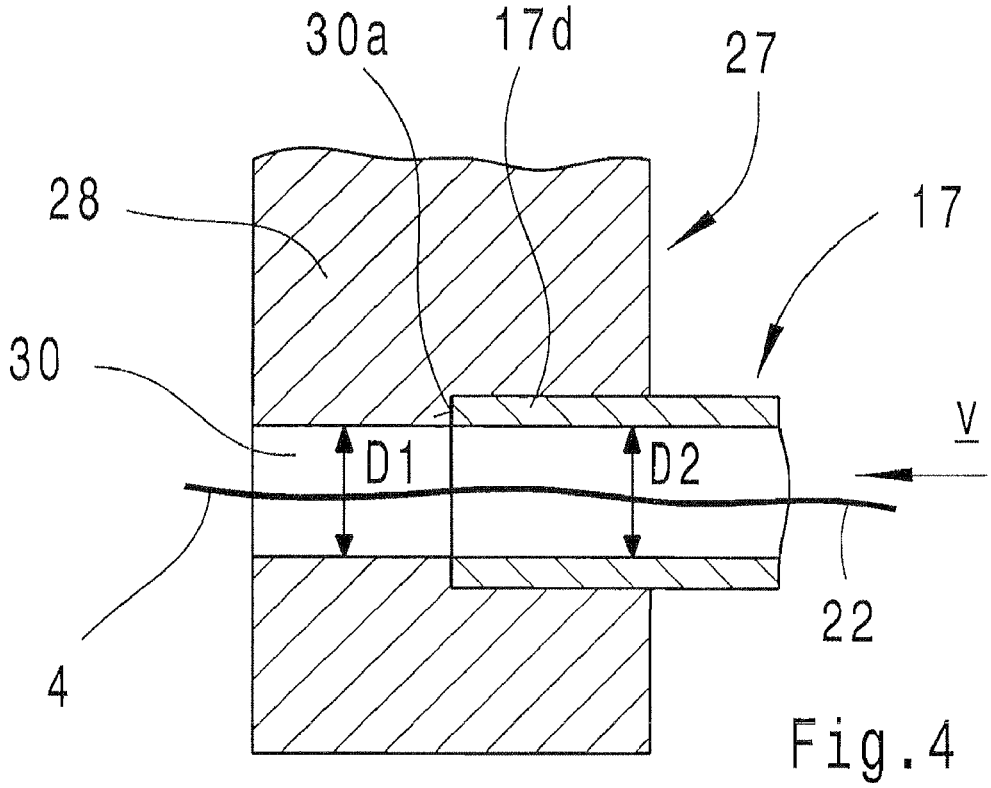
FIG. 4 shows an enlarged detail X of FIG. 3.

As FIG. 4 in particular shows, the thread guide 27 has a passage 30, which has an inlet section, which is located on the right in FIG. 4 and extends as far as a step 30*a*, and an outlet section, which is located on the left in FIG. 4 and extends as far as an outlet opening, wherein in the exemplary embodiment both sections extend over about half the thickness of the plate 28. The inlet section is provided with an inner cross-section that is slightly larger than an inner cross-section D1 of the outlet section and substantially corresponds to an outer cross-section of an outlet end 17*d* of the transport tube 17 also indicated in FIG. 2. In addition, the outlet end 17*d* of the transport tube 17 projects into the passage 30 as far as the step 30*a* and is connected firmly and also in as gastight a manner as possible to the plate 28 by gluing or other means. An inner cross-section of the outlet end 17*d* has a dimension D2 that is the same as dimension D1 in the exemplary embodiment. As a result, the transport duct enclosed by the transport tube 17 is extended in a stepless manner and preferably also coaxially from the outlet section of the passage 30 of the thread guide 27 without any narrowing in cross-section, steps or the like resulting that could encourage fibre accumulations or the like and thus blockages in the region of the thread guide 27.

Figure 5:
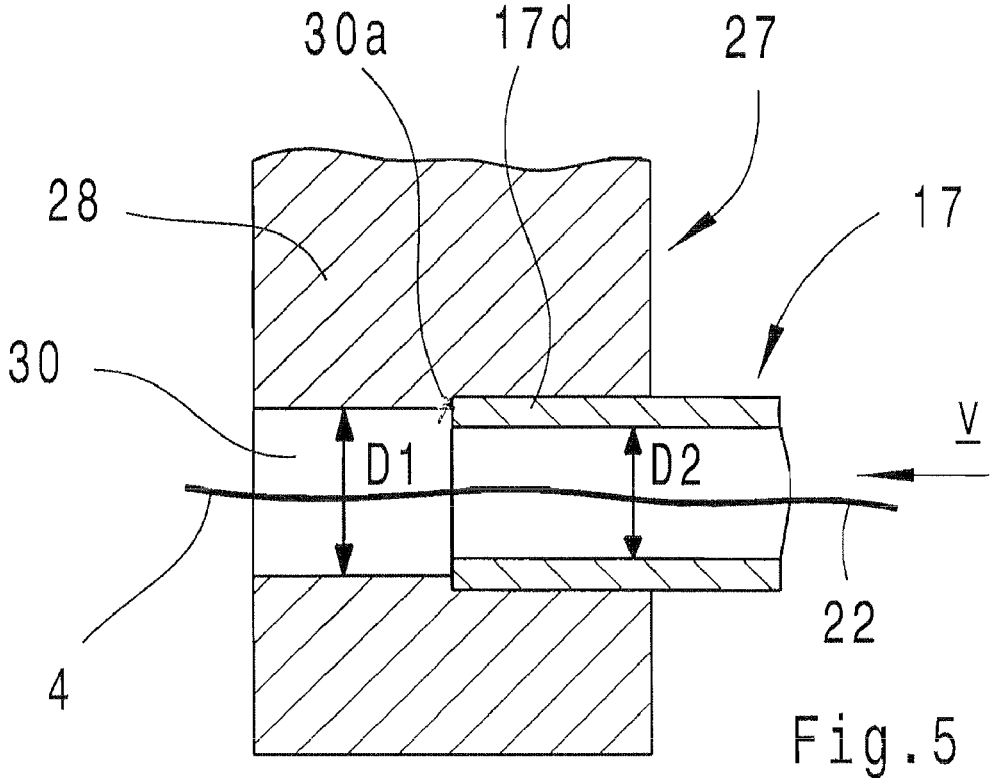
FIG. 5 is a view corresponding to FIG. 4 of a second exemplary embodiment.

The exemplary embodiment of the thread guide 27 according to FIG. 5 considered the best hitherto, in which identical parts are provided with the same reference numerals as in FIG. 4, only differs from the exemplary embodiment according to FIG. 4 in that the inner cross-section D1 of the outlet section of the passage 30 is larger than the inner cross-section D2 of the outlet end 17*d* of the transport tube 17. The height of the step 30*a* is slightly smaller here than the wall thickness of the transport tube 17 at the outlet end 17*d*. Therefore, up to the outlet of the passage 30 facing the needles 3, its inner cross-section is widened in comparison to that of the outlet end 17*d*.

The transport tube 17 is preferably hollow-cylindrical throughout and is provided with circular inside and outside diameters that are constant over its length, in which case the cross-sections in the region of the inlet and outlet sections of the passage 30 are also circular. The dimensions D1 and D2 then correspond to the diameters of the respective parts.

Because D1≧D2, the advantage is obtained that no fibres can collect or blockages as a result of fibres can occur in the passage 30, in particular in its outlet section. Moreover, the gapless arrangement of the outlet end 17*d* in the passage 30 provides the advantage that the temporary yarn 22 is guided by the compressed air introduced by the twist element 16 into the transport tube 17 into the direct vicinity of the needle hook 19 (FIG. 3) and the compressed or blast air remains active into the needle region. In particular, it has resulted that in the case of suitable adjustment of the magnitude of the blast air flow in the transport tube 17 or in the transport tubes 17*a*, 17*b* and 17*c*, possibly to be determined by tests, the suction element 20 (FIG. 1) can be omitted altogether, as a result of which costs and energy are saved. Thus, to securely insert the fibre materials 4 into the hooks 19 of the knitting needles 3 brought into the fibre pick-up position, no further auxiliary means in the form of additional blast or suction air flows or the like are necessary. Moreover, the intensity of the blast air flow is preferably selected to be so great that, irrespective of whether the knitting needles 3 are located in a fully raised, a non-raised or an only partially raised position, the fibre materials 4 can be transported to behind the line formed by the knitting needles 3, as may be desired, for example, for automatic start-up of a stitch forming process after a break of the fibre material or for other reasons.

Figure 6:
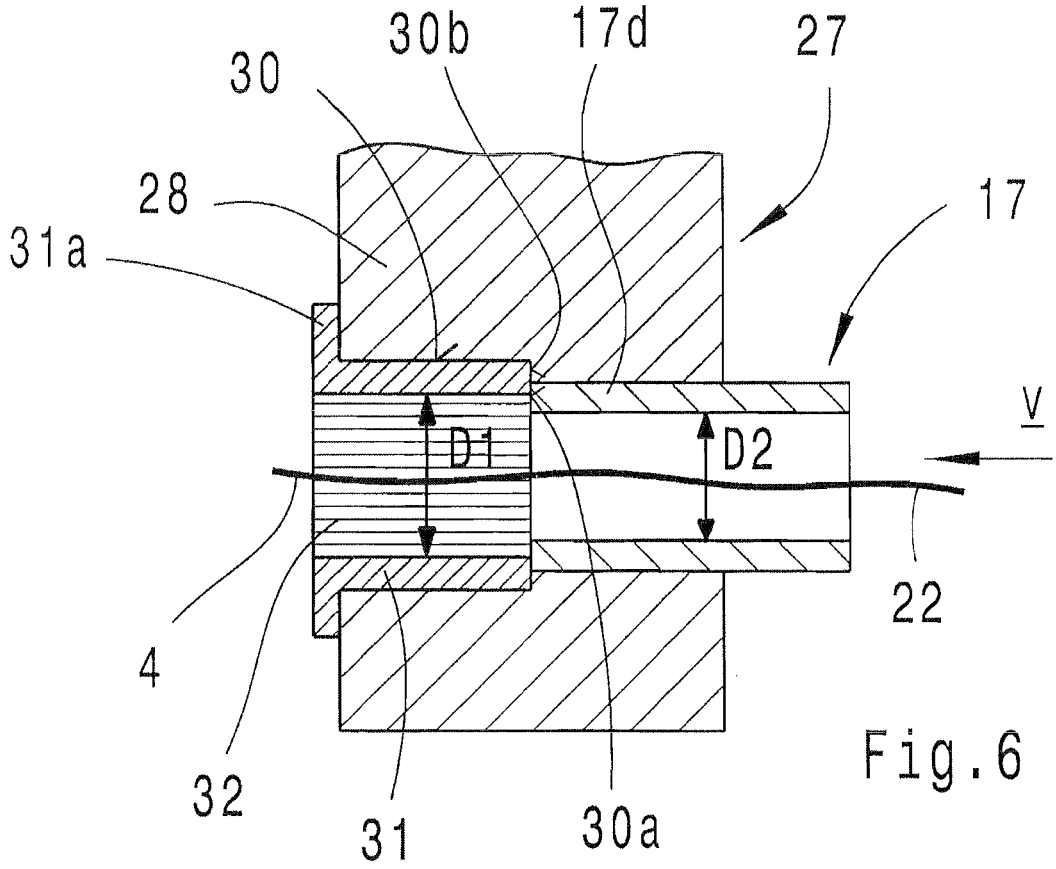
FIGS. 6 to 8 show vertical sections through three further exemplary embodiments of the invention.
Figure 7:
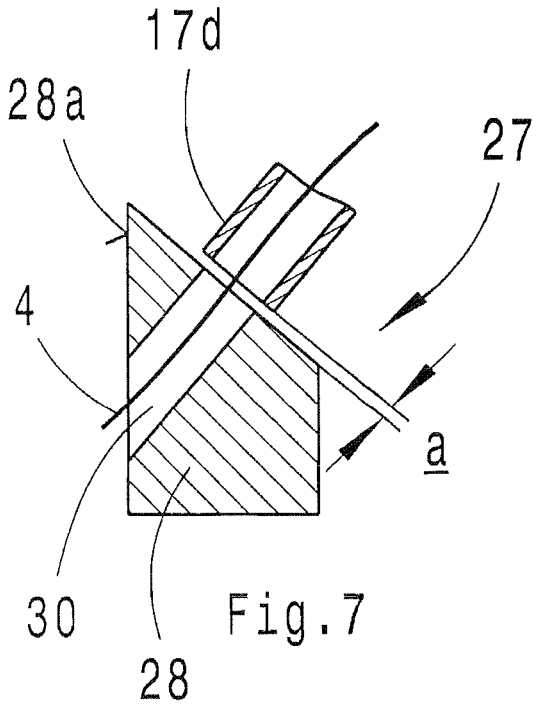
Figure 8:
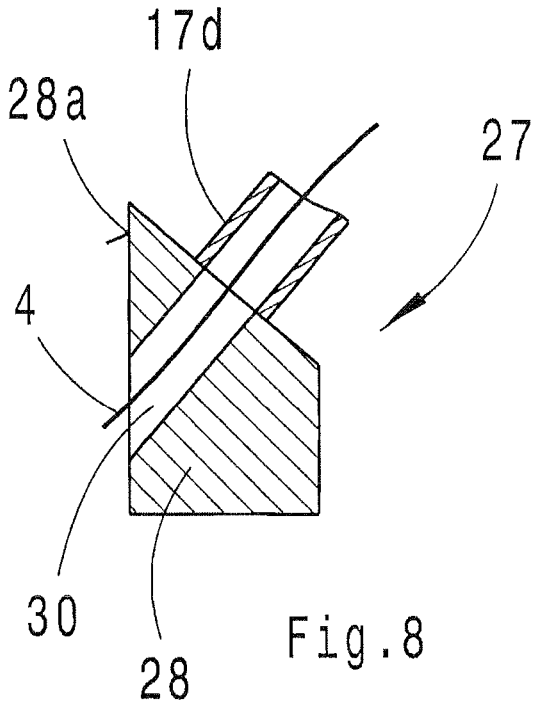

FIGS. 6 to 8 show further exemplary embodiments of the invention in representations corresponding to FIGS. 4 and 5.

In contrast to FIGS. 4 and 5, in the exemplary embodiment according to FIG. 6 the outlet section of the passage 30 has a larger inner cross-section than the inlet section, so that a step 30*b* pointing in the opposite direction compared to FIGS. 4 and 5 results. Moreover, a bushing 31 extending as far as the step 30*b* is inserted into the outlet section that has an outer cross-section corresponding to the outlet section and an inner cross-section that is smaller than the inner cross-section of the inlet section of the passage 30 and has the dimension D1, so that here the inner face of the bushing 31 forms the step 30*a* according to FIGS. 4 and 5. In addition, as in FIGS. 4 and 5, the outlet end 17*d* of the transport tube 17 extending as far as the step 30*a* is inserted into the inlet section of the passage 30. In the exemplary embodiment, this outlet end 17*d* has an inner cross-section with the dimension D2<D1, wherein, however, D1=D2 could also apply.

On the side of the thread guide 27 containing the outlet opening the bushing 31 is provided with a mounting flange 31*a*, which rests against the inside wall of the plate 28, and has, for example, groove-like guide elements 32 for the fibre material 4 machined into its inner shell.

The exemplary embodiments according to FIGS. 7 and 8 show thread guides 27, the passages 30 of which have centre axes, which are arranged on an angle to a front surface 28*a* of the thread guide 27 standing opposite the needles 3 and having the outlets for the fibre material 4. In the mounted state of the thread guide 27, the surface 28*a* stands substantially perpendicular and the angle between it and the axes of the passages 30 lies somewhere in the region of between 0° and 90°, preferably at approximately 45°. Thread guides 27 of this type are above all suitable for circular knitting machines, in which the respective last transport tube 17*c* (FIG. 1) is directed on an angle from the top downwards.

As the exemplary embodiment according to FIG. 7 shows, the outlet end 17*d* of the transport tube 17 ends at a small distance a in front of the inlet section of the passage 30. In this case, it is also expediently arranged coaxially to the passage 30, wherein for its inner cross-section D1≧D2 applies, as in the other exemplary embodiments (cf. FIG. 4, for example). To prevent any escape of air to the side as far as possible in this variant that is not gapless, the dimension a should not be larger than approximately 5 mm and the passage 30 should already have a larger inner cross-section at its inlet opening than the outlet end 17*a*. By suitable dimensioning of the intensity of the blast air flow in the transport tube 17 (or 17*c*) it can also be assured here that the fibre material exiting from the thread guide 27 is securely inserted into the hooks 19 of the knitting needles located in fibre pick-up position without any further aid.

FIG. 8 finally shows a variant, in which the outlet end 17*d* of the transport tube 17 abuts against the thread guide 27 without any gaps and preferably completely tightly from the outside. For its secure fastening to the thread guide 27, the outlet end 17*d* could be provided with a mounting flange that corresponds to the mounting flange 31*a* for the bushing 31 shown in FIG. 6.

The exemplary embodiments according to FIGS. 6 to 8 function in the same manner as the exemplary embodiments according to FIGS. 4 and 5.

Figure 9:
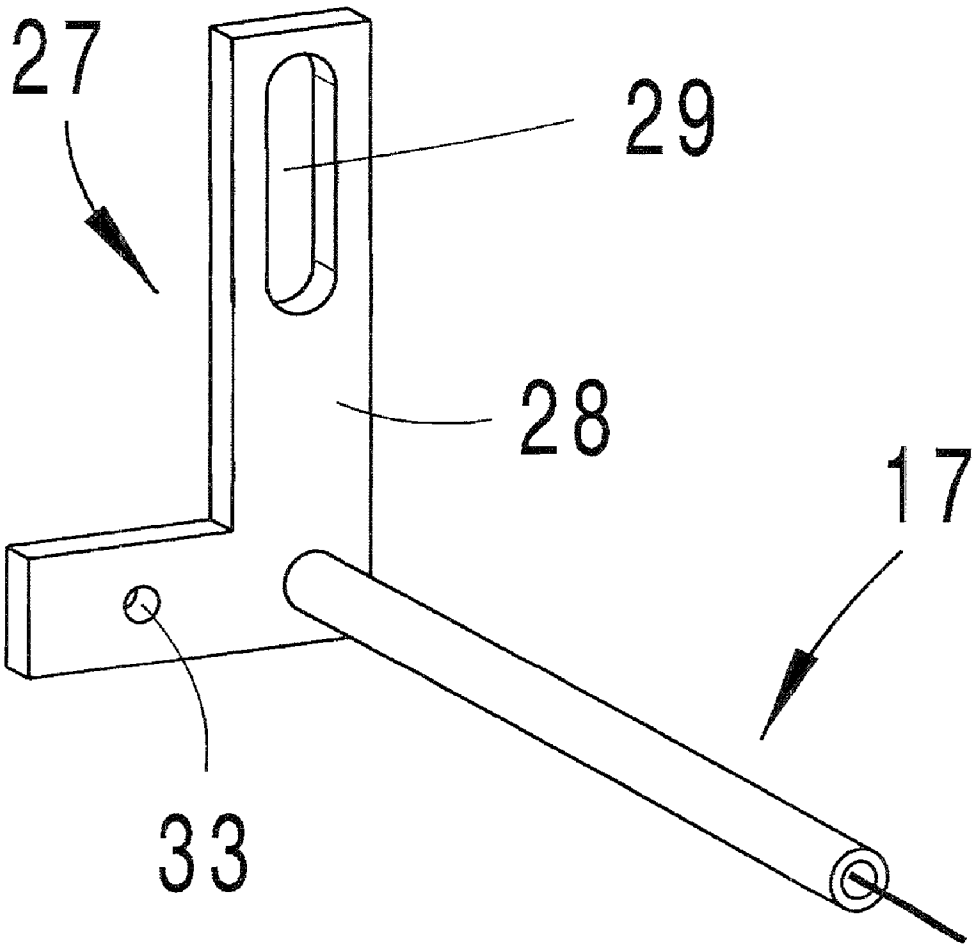
FIG. 9 is a perspective representation of a thread guide according to the invention that is connected to a transport tube and is suitable for the additional feed of an auxiliary thread.

The exemplary embodiments for the connection of the transport tube 17 to the thread guide 27 described on the basis of FIGS. 3 to 8 can be applied accordingly to the respective last transport tube 17*c* if several units consisting of a twist element 16 and a transport tube 17 connected one behind the other are provided, as shown in FIG. 1, for example. Moreover, it is possible to provide the thread guide 27 according to FIG. 9 with an additional passage 33, through which the auxiliary thread 12 shown in FIG. 1, for example, can be fed directly to the needles 3.

A particularly expedient variant results if the transport tube 17 is connected to the thread guide 27 in a pivoting or adjustable manner. The exemplary embodiments described on the basis of FIGS. 7 to 9, for example, are applicable for this. The outlet end 17*d* of the transport tube 17 in this case is coupled to the passage 30 of the thread guide 27, for example, so that with a plurality of possible angle positions its axis can expediently be pivoted both vertically and horizontally relative to the axis of the passage 30. As a result of this, it is possible, for example, to adjust the position of the transport tube 17 relative to the thread guide 27 without changing a preferred position of the thread guide 17 for technical knitting-related reasons and/or without reconstructing the combination comprising thread guide 27 and transport tube 17. This can be expedient, for example, as a result of a position of the spinning device 15 relative to the stitch-forming machine that is preferred in an individual case. Particularly advantageous is an arrangement, in which the outlet of the thread guide 27 or of the outlet end 17*d* of the transport tube 17 extending as far as this can be adjusted with a selectable angle relative to the surface 28*a* in FIGS. 7 and 8.

Figure 10:
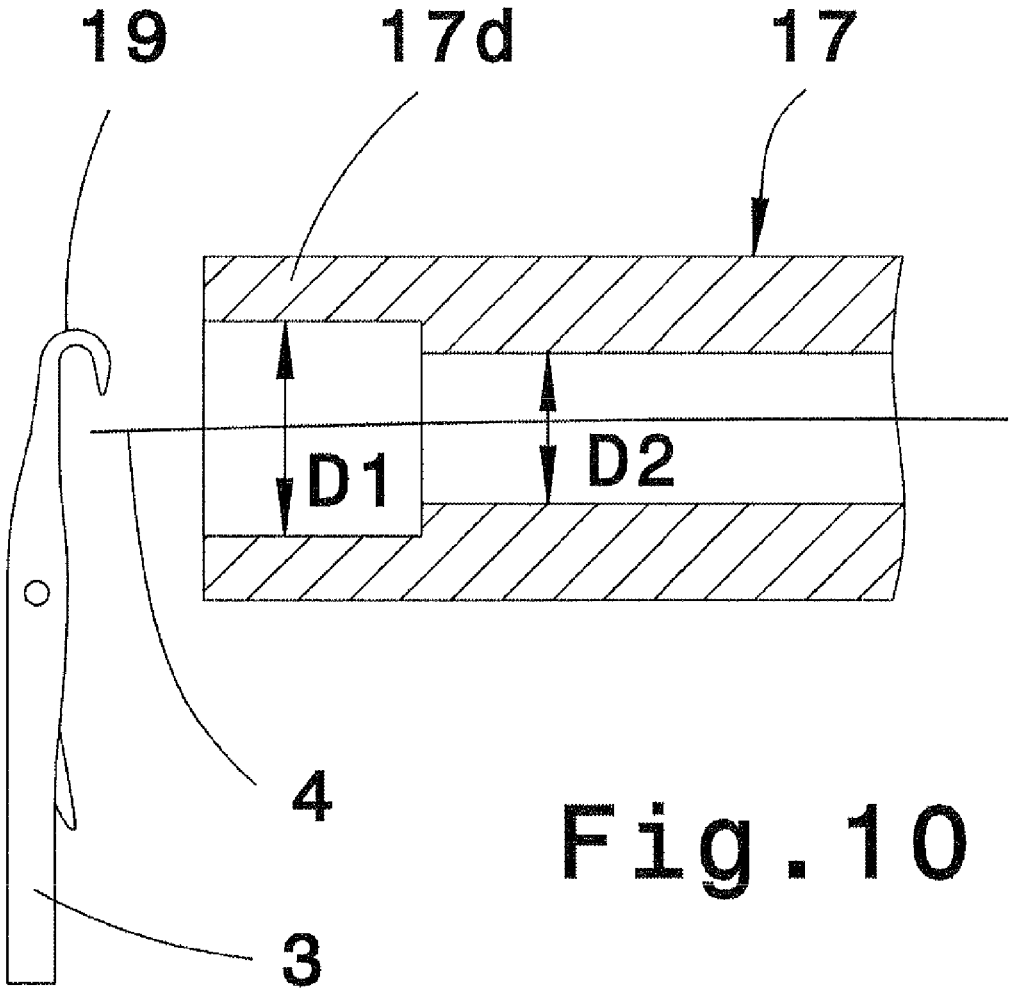
FIG. 10 shows a further embodiment of the invention without the thread guide and with a widened outlet end of the transport tube.

The invention is not restricted to the described exemplary embodiments that can be modified in a variety of ways. In particular it is clear that FIGS. 3 to 9 only represent exemplary embodiments, from which a wide variety of deviations can be made. For example, it would be possible to reduce the steps 30*a* in FIGS. 5 and 6 to the value zero or have them point in the opposite direction and to define the size of the active passage of the thread guide 27 both in the inlet and in the outlet section, analogously to FIG. 6, by means of inserted sleeves. Naturally it would also be possible to have the outlet end 17*d* project through the passage 30 over its entire length. It would be further possible to gradually widen the passage 30 and/or the outlet end 17*d* conically in the direction of its outlets standing opposite the needles 3. In this case, in the entire region of the passage 30 following the outlet end 17*d* the dimension D1 would also be the same size or larger than dimension D2. Moreover, the transport tube 17 can have a different shape and be connected to the thread guide 27 in a different manner. The shape of the twist element evident from FIG. 2 can also be changed as expedient. Moreover, it can be provided that solely normal threads consisting of twisted yarn instead of the described fibre materials 4 are fed to the knitting needles 3 at some knitting locations of the circular knitting machine to thus generate knitted goods with combined characteristics. In cases in which a thread guide 27 is not needed, e.g. when tubular or compound needles are applied, it can be additionally expedient to widen the inner cross-section of the outlet end 17*d* of the transport tube 17 at its end facing the needles 3 conically or in the form of a step to thus also achieve the explained effects when the thread guide 27 has been omitted, as shown by way of example in FIG. 10. Moreover, the invention is not restricted to circular knitting machines, but can accordingly also be transferred to other stitch-forming machines, in particular knitting and hosiery machines. Finally, it is understood that the different features can also be applied in other combinations that those described and represented.

The invention claimed is:

1. A machine for producing a knitted product by at least partly using untwisted fibre material (4), comprising:

at least one stitch forming system, on which stitch-forming elements (3) can be brought into a fibre pick-up position;

a thread guide (27), which is arranged in front of the stitch-forming system and has a passage (30) for the fibre material (4);

a drafting assembly (9) associated with the stitch-forming system for attenuation of the fibre material; and a spinning device (15), which is arranged between the drafting assembly (9) and the thread guide (27) and contains at least one spinning element (16) working with a blast air flow and a transport tube (17) connected thereto, which contains an outlet end (17*d*) for the fibre material opening into the thread guide (27), wherein the outlet end (17*d*) has an inner cross-section (D2), which is exactly the same size as or smaller than an inner cross-section (D1) at an outlet end of the passage (30), and wherein the intensity of the blast air flow is selected such that this is sufficient at least to securely transport the fibre material (4) as far as the stitch forming elements (3) without further auxiliary means.

2. A machine for producing a knitted product by at least partly using untwisted fibre material (4), comprising:

at least one stitch forming system, on which stitch-forming elements (3) can be brought into a fibre pick-up position;

a thread guide (27), which is associated with the stitch-forming system and has a passage (30) for the fibre material (4);

a drafting assembly (9) associated with the stitch-forming system for attenuation of the fibre material; and a spinning device (15), which is arranged between the drafting assembly (9) and the thread guide (27) and contains at least one spinning element (16) working with a blast air flow and a transport tube (17) connected thereto, which contains an outlet end (17*d*) for the fibre material opening into the thread guide (27), wherein the outlet end (17*d*) has an inner cross-section (D2), which is exactly the same size as or smaller than an inner cross-section (D1) at an outlet end of the passage (30), and wherein the intensity of the blast air flow is selected such that this is sufficient at least to securely transport the fibre material (4) as far as the stitch forming elements (3) without further auxiliary means, wherein the passage (30) in an inlet section has an inner cross-section, which substantially corresponds to an outer cross-section of the outlet end (17*d*) of the transport tube (17), and that the outlet end (17*d*) of the transport tube (17) projects at least partially into the passage (30).

3. The machine according to claim 2, wherein in an outlet section arranged behind the outlet end (17*d*) the passage (30) has an inner cross-section (D1) larger than the inner cross-section (D2) thereof and in an inlet section receiving the outlet end (17*d*) has an inner cross-section corresponding to the outer cross-section of the outlet end (17*d*).

4. The machine according to claim 3, wherein the inlet section merges into the outlet section at a step (30*a*), and the outlet end (17*d*) of the transport tube (17) abuts against the step (30*a*).

5. The machine according to claim 1, wherein a bushing (31) is inserted into the inlet and/or outlet section of the passage (30).

6. A machine for producing a knitted product by at least partly using untwisted fibre material (4), comprising:

at least one stitch forming system, on which stitch-forming elements (3) can be brought into a fibre pick-up position;

a thread guide (27), which is arranged in front of the stitch-forming system and has a passage (30) for the fibre material (4);

a drafting assembly (9) associated with the stitch-forming system for attenuation of the fibre material; and a spinning device (15), which is arranged between the drafting assembly (9) and the thread guide (27) and contains at least one spinning element (16) working with a blast air flow and a transport tube (17) connected thereto, which contains an outlet end (17*d*) for the fibre material opening into the thread guide (27) wherein the outlet end (17*d*) has an inner cross-section (D2) which is exactly the same size as or smaller than an inner cross-section (D1) at an outlet end of the passage (30), and wherein the intensity of the blast air flow is selected such that this is sufficient at least to securely transport the fibre material (4) as far as the stitch forming elements (3) without further auxiliary means, wherein a bushing (31) is inserted into the inlet and/or outlet section of the passage (30), and wherein the bushing (31) has an inner shell provided with guide elements (32) for the fibre material (4).

7. The machine according to claim 1, wherein an outlet of the thread guide (27) adjoins a surface (28*a*), which with an axis of the passage (30) forms an angle of between 0° and 90°.

8. The machine according to claim 1, wherein the thread guide (27) is provided with an additional passage (33) for an auxiliary thread (12).

9. The machine according to claim 1, wherein the outlet end (17*d*) merges into the passage (30) of the thread guide (27) without any gap.

10. The machine according to claim 1, wherein the spinning device is arranged for the production of a temporary yarn (22) and the spinning element (16) is configured as a twist element.

11. The machine according to claim 1, wherein it is configured as a circular knitting machine.

12. A machine for producing a knitted product by at least partly using untwisted fibre material (4), comprising:

at least one stitch forming system, on which stitch-forming elements (3) can be brought into a fibre pick-up position;

a drafting assembly (9) associated with the stitch-forming system for attenuation of the fibre material; and a spinning device (15), which is arranged between the drafting assembly (9) and the thread guide (27) and contains at least one spinning element (16) working with a blast air flow and a transport tube (17) connected thereto, which contains an outlet end (17*d*) for the fibre material, wherein the outlet end (17*d*) has a larger or widening inner cross-section compared to the remaining part of the transport tube (17), and wherein the intensity of the blast air flow is selected such that this is sufficient at least to securely transport the fibre material (4) as far as the stitch forming elements (3) without further auxiliary means.

* * * * *